US010619465B2

(12) United States Patent
Randle

(10) Patent No.: US 10,619,465 B2
(45) Date of Patent: Apr. 14, 2020

(54) LUBE AND BLEED CASING ADAPTOR

(71) Applicant: Spoked Solutions LLC, Houston, TX (US)

(72) Inventor: Bryce Elliott Randle, Highlands Ranch, CO (US)

(73) Assignee: Spoked Solutions LLC

( * ) Notice: Subject to any disclaimer, the term of this patent is extended or adjusted under 35 U.S.C. 154(b) by 13 days.

(21) Appl. No.: 15/958,850

(22) Filed: Apr. 20, 2018

(65) Prior Publication Data

US 2018/0306012 A1 Oct. 25, 2018

Related U.S. Application Data

(60) Provisional application No. 62/487,931, filed on Apr. 20, 2017.

(51) Int. Cl.

| | |
|---|---|
| ***E21B 43/12*** | (2006.01) |
| ***E21B 21/08*** | (2006.01) |
| ***F04D 13/04*** | (2006.01) |
| ***F04B 47/04*** | (2006.01) |
| ***E21B 33/08*** | (2006.01) |
| *E21B 47/04* | (2012.01) |
| *E21B 17/08* | (2006.01) |

(52) U.S. Cl.

CPC ..... *E21B 43/129* (2013.01); *E21B 21/08* (2013.01); *E21B 33/08* (2013.01); *F04B 47/04* (2013.01); *F04D 13/04* (2013.01); *E21B 17/08* (2013.01); *E21B 47/04* (2013.01)

(58) Field of Classification Search

CPC ..... E21B 21/08; F04B 47/04
USPC ..... 166/372
See application file for complete search history.

(56) References Cited

U.S. PATENT DOCUMENTS

| | | | | |
|---|---|---|---|---|
| 3,324,943 | A * | 6/1967 | Price | E21B 33/035 166/340 |
| 9,284,810 | B2 * | 3/2016 | Bryson | E21B 33/068 |
| 10,352,159 | B2 * | 7/2019 | Rowe | E21B 21/08 |
| 2007/0284113 | A1 * | 12/2007 | Haheim | E21B 19/004 166/345 |
| 2010/0025044 | A1 * | 2/2010 | McKay | E21B 33/035 166/359 |
| 2011/0214882 | A1 * | 9/2011 | Santos | E21B 21/08 166/373 |
| 2012/0318517 | A1 * | 12/2012 | Christensen | E21B 17/07 166/345 |

* cited by examiner

*Primary Examiner* — Taras P Bemko
(74) *Attorney, Agent, or Firm* — Sheridan Ross P.C.

(57) ABSTRACT

A casing adapter and related systems and methods are provided for a lubricate and bleed operation in a wellbore where heavy fluids are directly deposited downwell. The casing adapter allows a hose to be positioned downwell and to be operably connected to a tank of heavy fluid. Once the heavy fluid is deposited, the casing adapter receives lighter fluids from the well bore, and the casing adapter is operably connected to a return tank that stores lighter fluids.

20 Claims, 7 Drawing Sheets

LUBE AND BLEED CASING ADAPTOR

CROSS REFERENCE TO RELATED APPLICATION

This application claims the benefit of U.S. Application Ser. No. 62/487,931, filed on Apr. 20, 2017, which is incorporated by reference in its entirety.

FIELD OF THE INVENTION

The invention relates to an apparatus and methods for placing desired fluids in well annuli from surface and optimizing lube and bleed operations in an oil and gas well.

BACKGROUND OF THE INVENTION

In completed oil and gas wells, it is sometimes desired to place fluids downhole, either as far from surface as possible or at a predetermined distance from surface. Such fluids, typically intended to remedy an issue with the well, typically have a higher chance of successfully remedying the issue if applied as deep as possible. At the same time, as will be appreciated by those in the field, the cheapest and most readily available access point for inserting such fluids into the well is at the wellhead. One well known technique for placing desired fluids downhole via the wellhead is by a lubricate and bleed operation. During a lubricate and bleed operation, a fluid heavier than those already contained in the well is added through the wellhead without first removing any existing fluid from the well, adding to the total fluids in the well. Over a period of time, the heavier fluid travels downhole as lighter fluid migrates up the well. The lighter fluid is then removed from the well at the wellhead until total displacement is returned to the original value. The process is repeated until the desired amount of fluid has been added to the well, requiring multiple periods of wait time while the heavier fluid travels downhole and lighter fluid migrates to the wellhead. Further, wells will sometimes be under pressure, which decreases the amount of fluid that can be introduced into the well in any given phase of the lubricate and bleed operation.

Due to the significant time inefficiencies associated with lubricate and bleed operations, what is needed in the industry is an improved method and apparatus of conducting lubricate and bleed operations that eliminates the delay associated with waiting for lighter fluids to migrate through heavier fluids placed at the wellhead.

SUMMARY OF THE INVENTION

The invention would provide a Lube and Bleed Casing Adaptor (LBCA) that may be used to eliminate inefficiencies and improve accuracy in traditional lubricate and bleed operations, as well as other well operations where fluids must be placed downhole through the wellhead. In one embodiment of the invention, the LBCA allows for placing fluids at a desired downhole depth in a well that is not under pressure using an expandable outer diameter hose that minimizes friction pressure. In another embodiment of the invention, the LBCA allows for placing fluids at a desired downhole depth in a well that is under pressure using a fixed outer diameter hose that is lubricated into place. In each embodiment, a bleed capability of the LBCA allows fluid and pressure to bleed during the lubricate and bleed operation. Because the invention provides a means to directly place fluids at a desired depth, the need to wait until heavier fluid falls and lighter fluid migrates up is eliminated.

An objective of the invention is to provide an improved apparatus and method of placing a desired fluid as far below surface as possible while introducing the fluid from the wellhead.

Another objective of the invention is to provide an apparatus and method that facilitates bleeding a predetermined amount of pressure from a well while lubricating a desired volume of fluid into the well without first waiting for lighter fluids to first migrate to toward surface.

A further objective is to provide an apparatus and method that facilitates placing a desired fluid downhole in both pressured and unpressured environments.

An apparatus of this nature will also provide significant cost and time savings by eliminating the mandatory wait time associated with traditional lubricate and bleed operations.

An apparatus of this nature may provide greater placement accuracy and certainty than can be achieved with traditional lubricate and bleed operations.

A specific embodiment of the present invention is a method of pumping a fluid in a wellbore, comprising (i) providing a casing adapter that defines an enclosed volume, the casing adapter having an inlet, an outlet, and a port aperture all in operable communication with the enclosed volume; (ii) deploying a hose having a proximal end and a distal end through the inlet, through the enclosed volume, and through the port aperture to divide the enclosed volume into a hose volume and an annulus volume, wherein a clearance is defined between an outer surface of the hose and an inner surface of the port aperture; (iii) deploying the hose through a port of a wellhead and into a wellbore that extends from the wellhead until the distal end of the hose is a predetermined distance from the port of the wellhead; (iv) selectively connecting the casing adapter to the wellhead so that the port aperture is in operable communication with the port of the wellhead and the wellbore; (v) pumping a first fluid through the inlet, through the hose and the hose volume, and out of the distal end of the hose into the wellhead; and (vi) receiving a second fluid from the wellhead, through the annulus volume, and out of the outlet.

In some embodiments, the method further comprises (vii) retracting the hose through the wellbore, through the enclosed volume of the casing adaptor, and through the inlet. In various embodiments, the hose has a relaxed outer diameter, and the hose has an expanded outer diameter when the first fluid is pumped through the hose, and wherein the expanded outer diameter is greater than the relaxed outer diameter.

In some embodiments, the method further comprises (viii) applying a lubricant to the outer surface of the hose as the hose is deployed through the inlet. In various embodiments, the hose is deployed through the inlet, through the enclosed volume, and through the port aperture prior to the port aperture being selectively connected to the port of the wellhead. In some embodiments, the first fluid is pumped from a first reservoir operably connected to the inlet and the second fluid is received in a second reservoir operably connected to the outlet, and the first fluid is denser than the second fluid.

Another particular embodiment of the present invention is a casing adapter for deploying a hose in a wellbore, comprising a body defining an enclosed volume; an inlet, an outlet, and a port aperture through the body of the casing adapter, wherein the inlet, the outlet, and the port aperture are in operable communication with the enclosed volume; a hose extending through the inlet, the enclosed volume, and the port aperture to divide the enclosed volume into a hose volume and an annulus volume, wherein the hose is sealably connected to the inlet; and a clearance space between an outer surface of the hose and an inner surface of the port aperture such that the annulus volume is in operable communication with a wellbore.

In various embodiments, the body comprises a sleeve having the inlet and the outlet; a crossover having the port aperture; and an adapter configured to secure a seal face of the crossover to a seal in the sleeve, and the adapter configured to selectively connect to the sleeve to sealably connect the crossover to the sleeve. In some embodiments, the inlet is oriented along a first axis and the outlet is oriented along a second axis, and the first axis and the second axis are perpendicular to each other. In various embodiments, the adapter further comprises a spring positioned in the annulus volume, a first end of the spring connected to an inner surface of the body, and a second end of the spring forming a coil around the outer surface of the hose. In some embodiments, the coil of the spring extends out of the port aperture.

In some embodiments, the adapter further comprises at least one expandable rubber positioned in the inlet of the body, wherein the at least one expandable rubber is configured to contact the outer surface of the hose; and a lubrication reservoir in operable communication with the inlet of the body, wherein the lubrication reservoir is configured to provide a lubricant on the outer surface of the hose. In various embodiments, the proximal end of the hose is positioned about an end of a swage connector, and the swage connector is connected to the body.

Yet another particular embodiment of the present invention is a system for deploying a hose in a wellbore, comprising: a wellbore extending from a port of a wellhead, the wellbore comprising an inner tubular structure positioned in an outer tubular structure, wherein a predetermined distance extends between an outer surface of the inner tubular structure and an inner surface of the outer tubular structure; a casing adaptor having a body and defining an enclosed volume; an inlet, an outlet, and a port aperture through the body of the casing, wherein the inlet, the outlet, and the port aperture are in operable communication with the enclosed volume, and the port aperture is in operable communication with the port of the wellhead; a hose extending through the inlet of the body, through the enclosed volume, through the port aperture, and into the wellbore, wherein the hose extends to a predetermined distance down the wellbore; and a pump operably connected to the inlet of the casing adapter, wherein the pump is configured to pump a fluid through the hose to the predetermined distance down the wellbore.

In some embodiments, the hose is expandable between a relaxed outer diameter and an expanded outer diameter, wherein the relaxed outer diameter is smaller than the predetermined distance and the expanded outer diameter is larger than the predetermined distance. In various embodiments, the hose is comprised from a rigid material, and an outer diameter of the hose is less than the predetermined distance. In some embodiments, an annular fluid between the inner tubular structure and the outer tubular structure is less dense than the fluid pumped to the predetermined distance down the wellbore.

In various embodiments, the hose divides the enclosed volume between a hose volume and an annulus volume, and wherein the casing adapter comprises a clearance between an outer surface of the hose and an inner surface of the port aperture such that the annulus volume is in operable communication with the port of the wellhead. In some embodiments, an annular fluid from the wellbore passes through the port aperture into the annulus volume and out of the outlet into a reservoir tank. In various embodiments, the inner tubular structure is production tubing and the outer tubular structure is a casing.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

The invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, and may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Figure 1A:
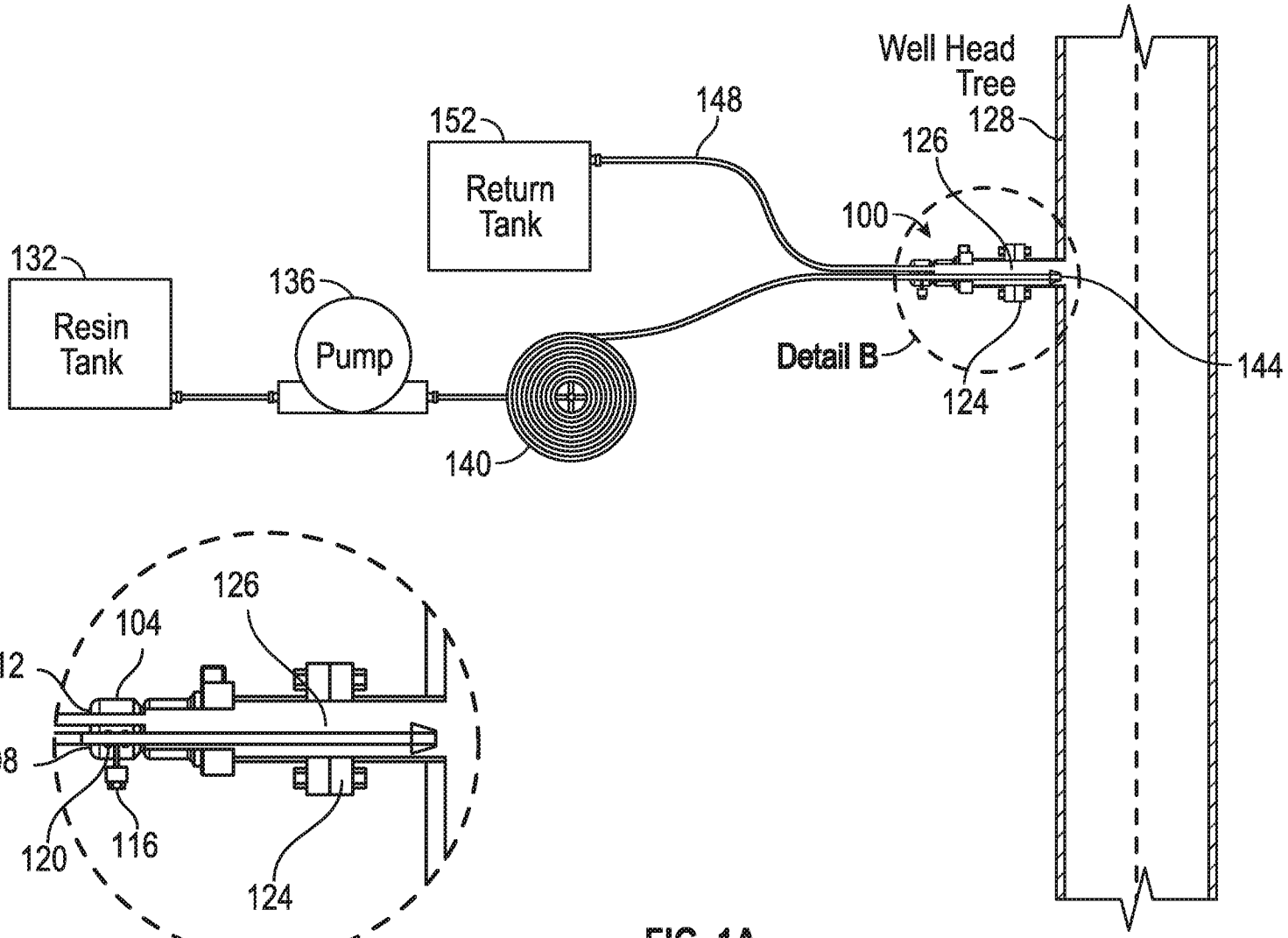
FIG. 1A is a diagram showing incorporation of one embodiment of the LBCA in a retracted position into a well system in accordance with embodiments of the present invention.
Figure 1B:
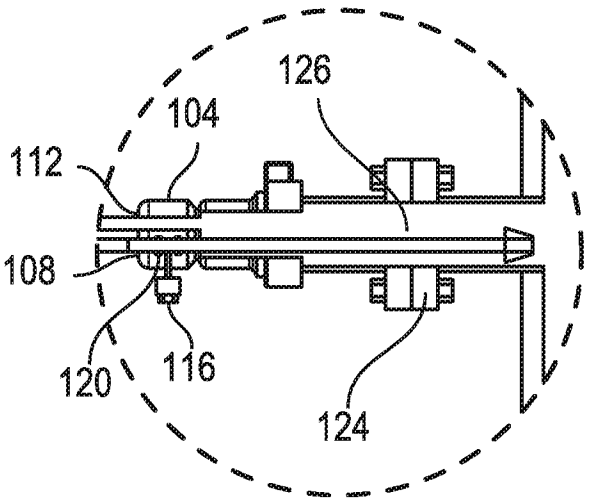
FIG. 1B is a detailed view of a portion of the diagram of FIG. 1A showing incorporation of one embodiment of the LBCA in a retracted position into a well system in accordance with embodiments of the present invention.
Figures 2A, 2B:
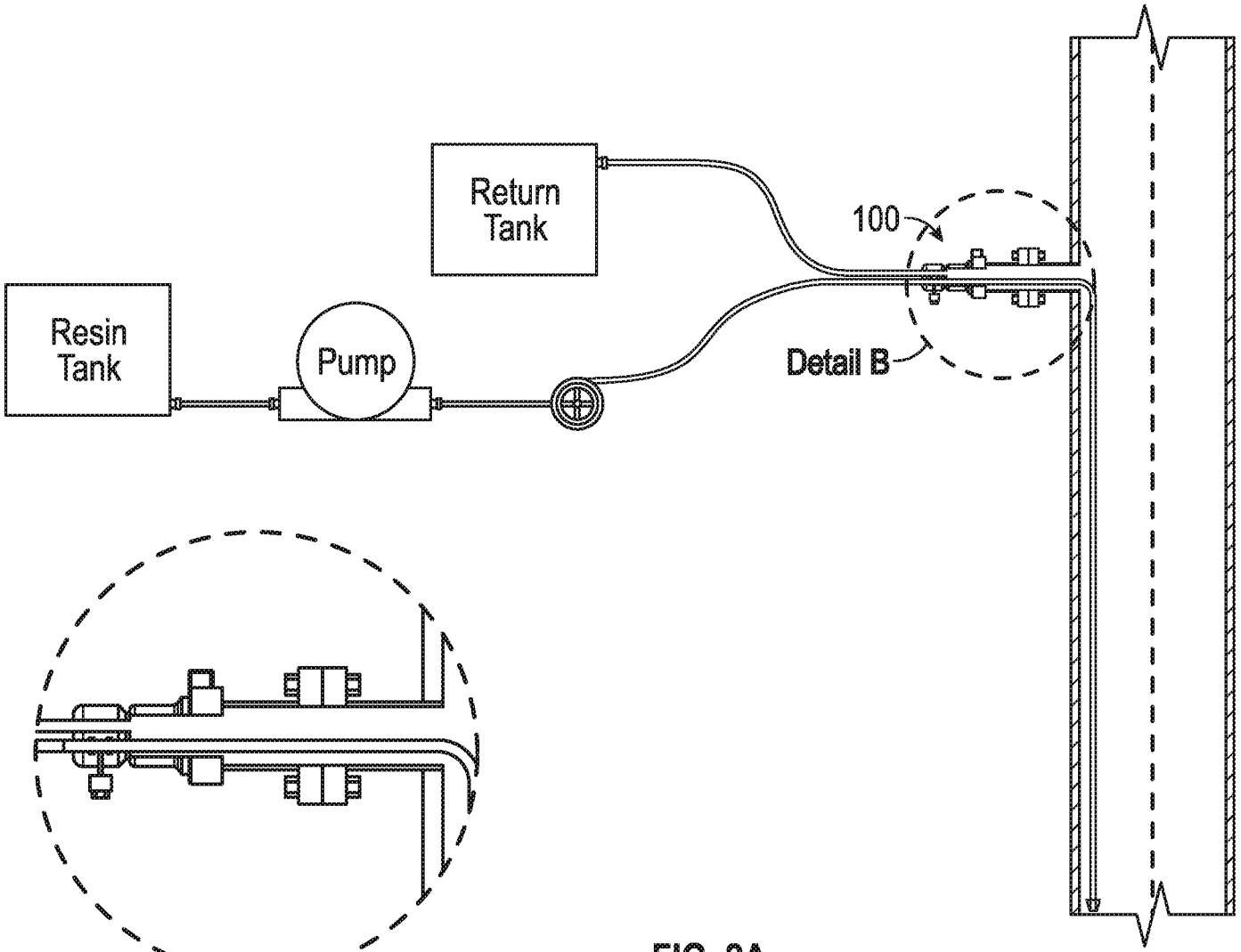
FIG. 2A is a diagram showing incorporation of one embodiment of the LBCA in an extended position into a well system in accordance with embodiments of the present invention.
FIG. 2B is a detailed view of a portion of the diagram of FIG. 2A showing incorporation of one embodiment of the LBCA in an extended position into a well system in accordance with embodiments of the present invention.

Now referring to FIGS. 1A, 1B, 2A, and 2B, diagrams showing incorporation of the LBCA, in a retracted and extended position, respectively, into a well system in accordance with some embodiments of the present invention are provided. LBCA 100 is comprised of body 104, which is further comprised of inlet 108, outlet 112, grease head lubricator 116, expandable rubbers 120, and port aperture 126. Port aperture 126 of LBCA 100 is coupled to wellhead port 124 of wellhead tree 128. Tank 132 is coupled to pump 136 which is coupled to retractable hose 140. Retractable hose 140 runs through inlet 108 of LBCA 100, and has an end 144. In FIG. 1, retractable hose 140 is retracted and hose end 144 is near surface. In FIG. 2, retractable hose 140 is extended and hose end 144 is downhole. When retractable hose 140 is in the extended position, retractable hose 140 runs downhole in the annulus between the inner diameter of an outer casing and the outer diameter of an inner casing. Return hose 148 is coupled on one end to outlet 112 of LBCA 100, and on the other end to return tank 152.

In one embodiment of the present invention, the well is not under pressure. In embodiments where the well is not under pressure, retractable hose 140 is made of an expandable material such that retractable hose 140 can flatten or bend. Further, in this embodiment, retractable hose 140 can expand to a larger outer diameter than the difference between the outer diameter of the inner casing and the inner diameter of the outer casing. It will be appreciated that the larger outer diameter of retractable hose 140 decreases friction and aids in faster deployment of fluids. An operator extends retractable hose 140 through inlet 108 until a desired depth of hose end 144 is reached. Pump 136 is then activated, causing fluid to be pumped from tank 132, through retractable hose 140, into the annulus at the depth of hose end 144. In an embodiment using an expandable outer diameter retractable hose 140, retractable hose 140 expands as fluid begins to flow through. Upon expanding, retractable hose 140 becomes wedged between casing strings, eliminating whipping and knotting potential. As desired fluid is pumped downhole from tank 132, existing fluid in the annulus is displaced. This displaced fluid is bled into return tank 152 through outlet 112 and return hose 148. Once the desired amount of fluid is placed downhole, pump 136 is deactivated, allowing the expandable embodiment of retractable hose 140 to dislodge from the casing string annulus and be retracted.

In another embodiment of the present invention, the well is under pressure. In embodiments where the well is under pressure, retractable hose 140 is made of a material that gives retractable hose 140 a fixed outer diameter. In this embodiment, retractable hose 140 will have a smaller outer diameter than the difference between the outer diameter of the inner casing and the inner diameter of the outer casing to facilitate placing the retractable hose 140 downhole while under pressure. To extend retractable hose 140 through inlet 108 and downhole in this embodiment, retractable hose 140 must be lubricated into place. To lubricate retractable hose 140 into place, grease is injected into expandable rubbers 120 using grease head lubricator 116. An operator uses an appropriate amount of grease to cause expandable rubbers 120 to maintain pressure on the outer diameter of retractable hose 140 as retractable hose 140 is fed through inlet 108 until hose end 144 reaches the desired depth. Pump 136 is then activated, causing fluid to be pumped from tank 132, through retractable hose 140, into the annulus at the depth of hose end 144. As desired fluid is pumped downhole from tank 132, existing fluid in the annulus is displaced. This displaced fluid is bled into return tank 152 through outlet 112 and return hose 148. Once the desired amount of fluid is placed downhole, pump 136 is deactivated, allowing retractable hose 140 to be retracted. In this embodiment, grease head lubricator 116 is used to add grease to expandable rubbers 120 to maintain appropriate pressure on the outer diameter of retractable hose 140 until retractable hose 140 is fully retracted and the valves of wellhead port 124 are closed.

Figure 3A:
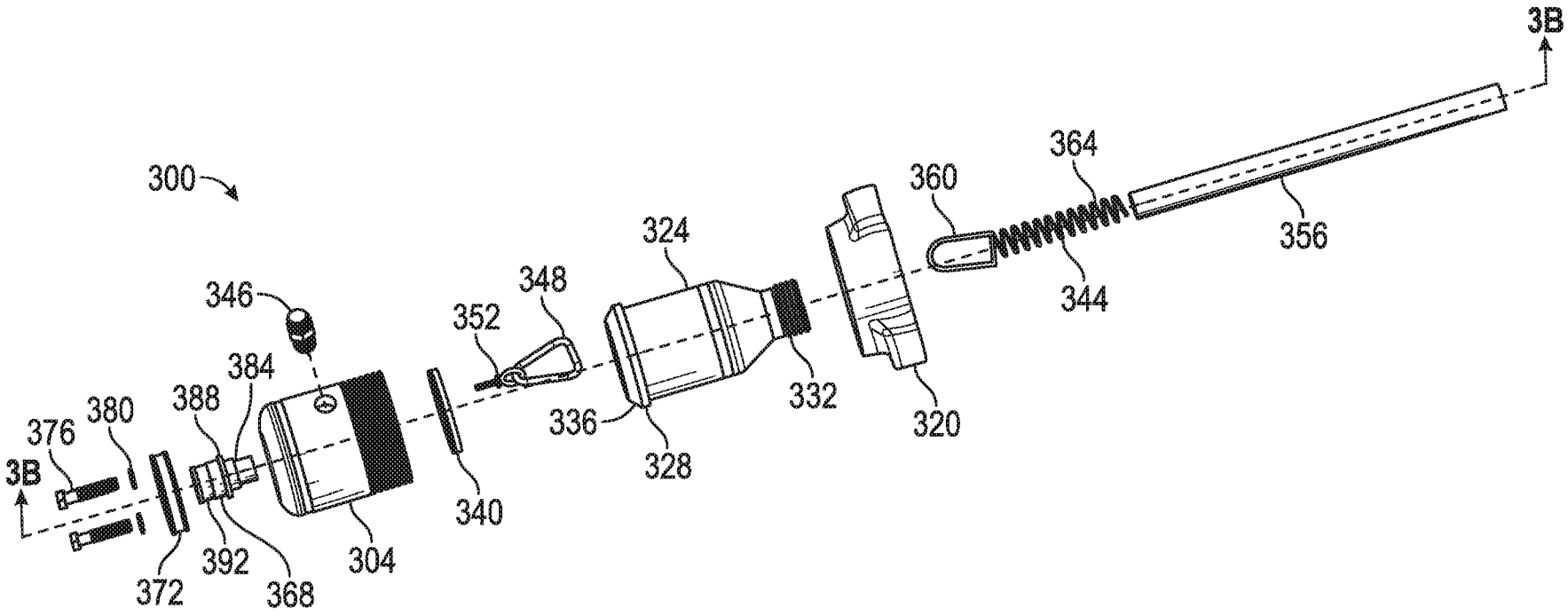
FIG. 3A is an exploded view of one embodiment of the LBCA in accordance with embodiments of the present invention.
Figure 3B:
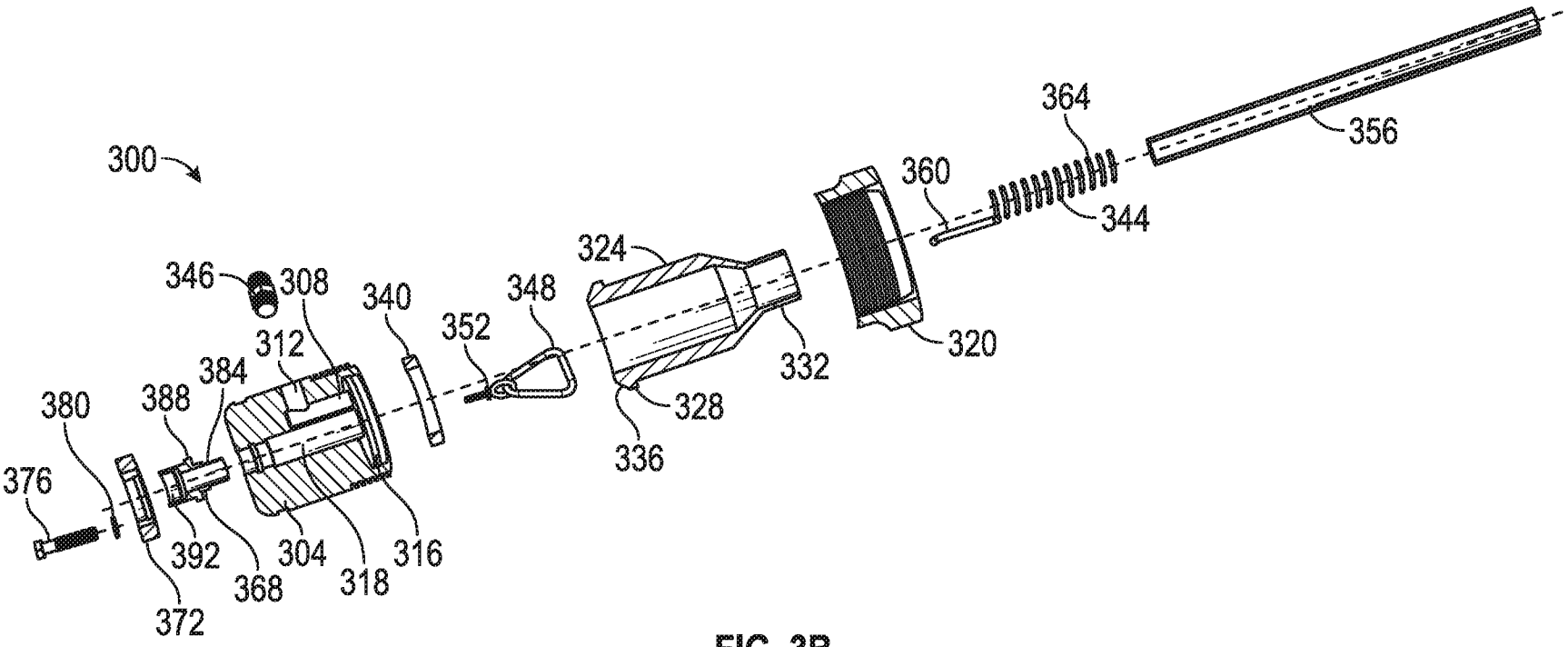
FIG. 3B is a cross-sectional view of the LBCA of FIG. 3A taken along line 3B-3B in accordance with embodiments of the present invention.
Figure 3C:
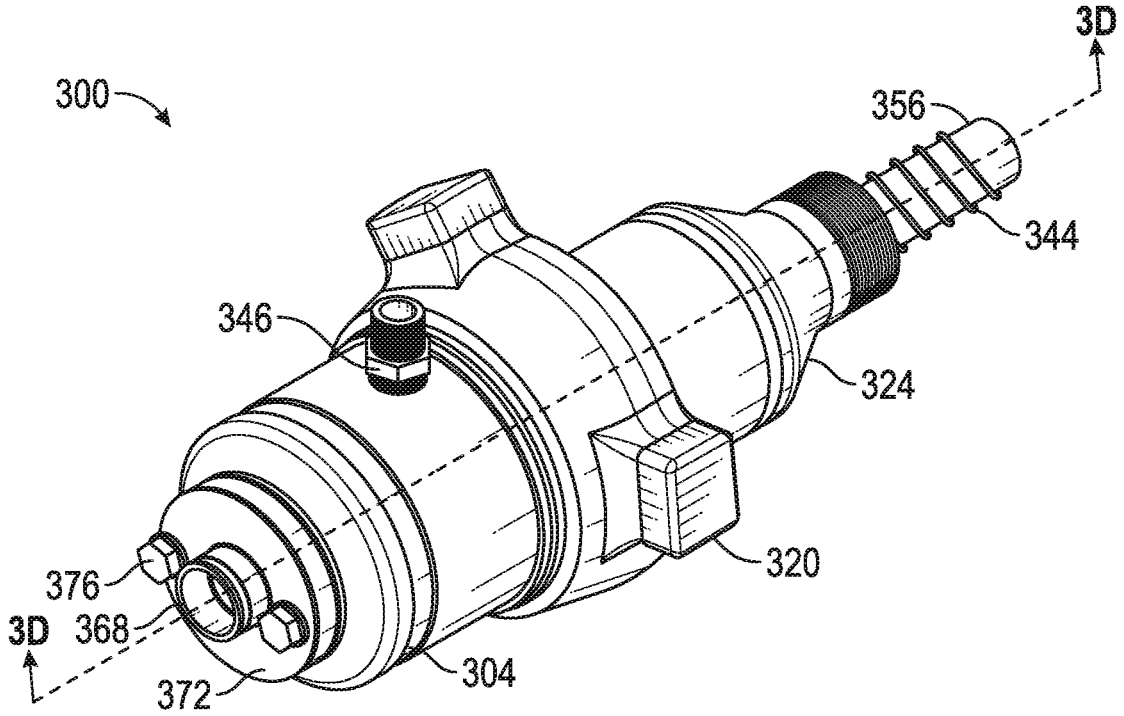
FIG. 3C is an isometric view of one embodiment of the LBCA in accordance with embodiments of the present invention.
Figure 3D:
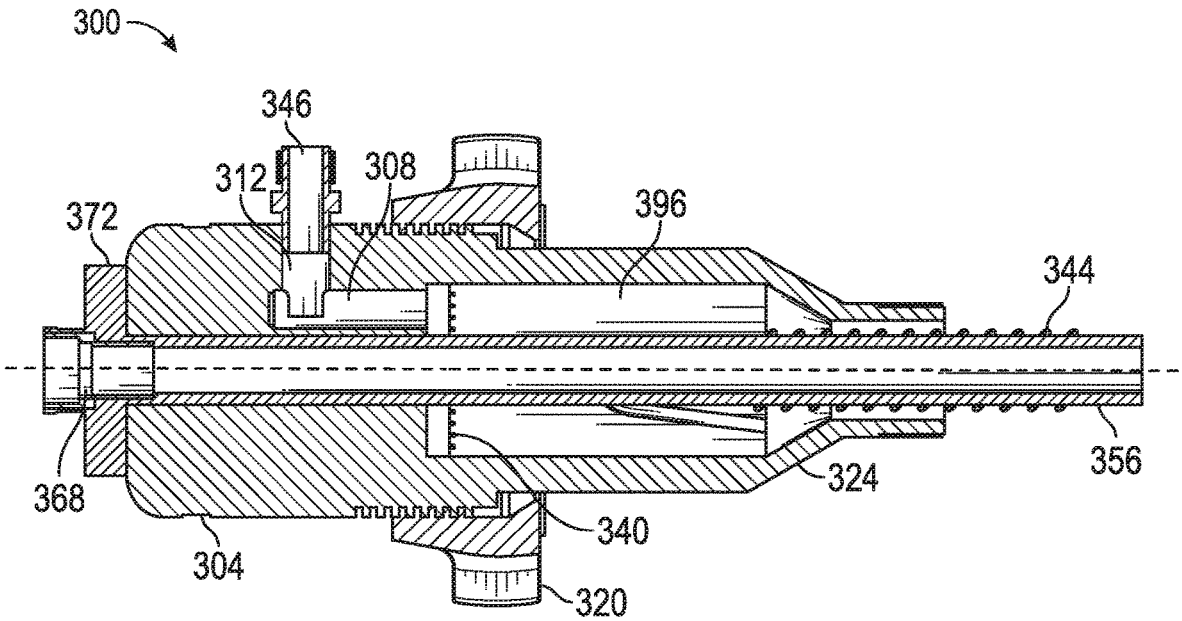
FIG. 3D is a cross-sectional view of the LBCA of FIG. 3C taken along line 3D-3D in accordance with embodiments of the present invention.
Figure 3E:
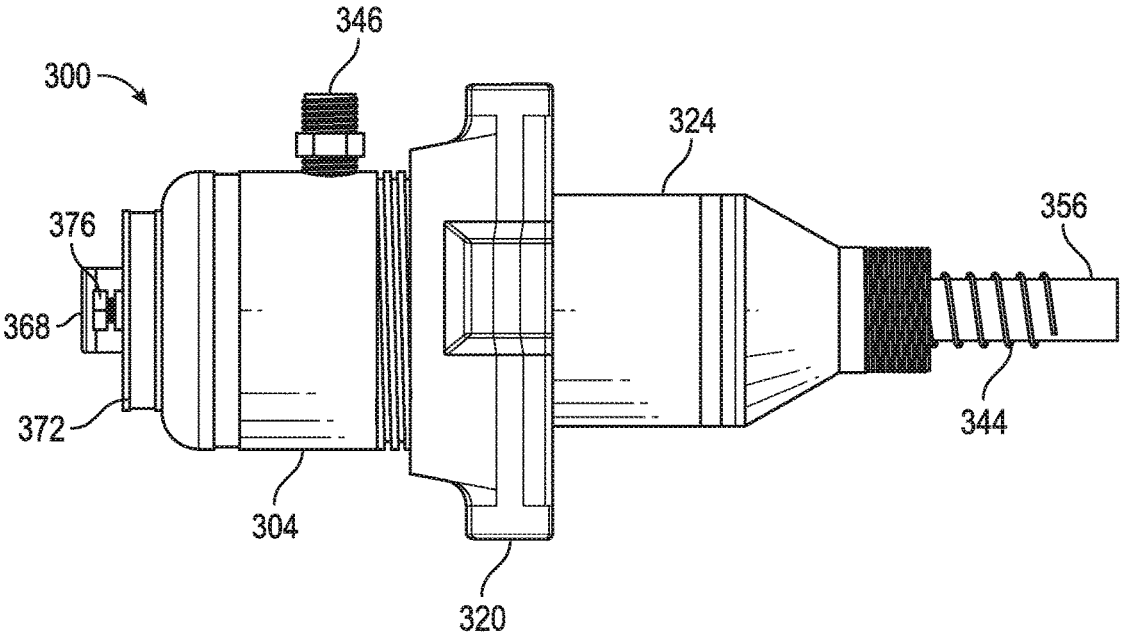
FIG. 3E is a side view of one embodiment of the LBCA in accordance with embodiments of the present invention.
Figure 3G:
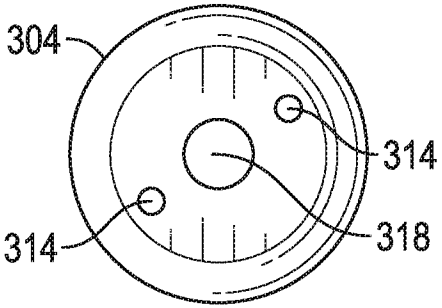
FIG. 3G is a further side view of an outer sleeve of one embodiment of the LBCA in accordance with embodiments of the present invention.
Figure 3I:
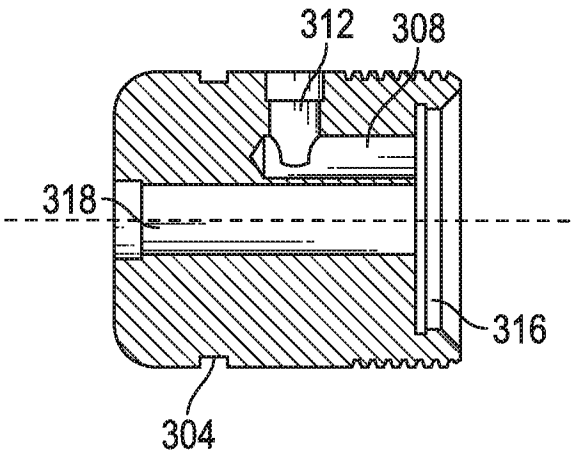
FIG. 3I is a cross-sectional view of an outer sleeve of the LBCA of FIG. 3H taken along line 3I-3I in accordance with embodiments of the present invention.
Figure 3F:
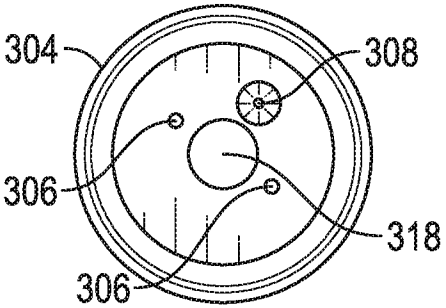
FIG. 3F is a side view of an outer sleeve of one embodiment of the LBCA in accordance with embodiments of the present invention.
Figure 3H:
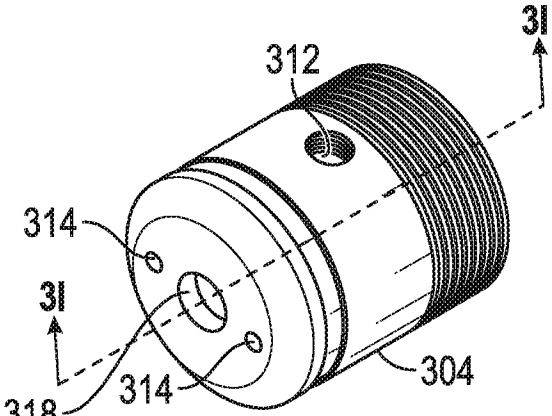
FIG. 3H is an isometric view of an outer sleeve of one embodiment of the LBCA in accordance with embodiments of the present invention.

Now referring to FIGS. 3A, 3B, 3C, 3D and 3E, exploded, cross-sectional, exploded cross-sectional, isometric, and side views of a LBCA in accordance with some embodiments of the present invention are provided. Further, referring to FIGS. 3F, 3G, 3H, and 3I, cross-sectional, isometric, top, and bottom views of an outer sleeve of a LBCA in accordance with some embodiments of the present invention are provided. LBCA 300 is comprised of outside sleeve 304, which is further comprised of eye screw connections 306, return channel 308, return outlet 312, swage plate screw connections 314, seal seat 316, and hose channel 318.

LBCA 300 is further comprised of union adapter 320, which is coupled to outside sleeve 304. Outside sleeve 304 may coupled to union adapter 320 via a threaded connection, although other connections well known in the art may be used. Union adapter 320 may be a Weco® 1502 adapter, although other adapters well known in the art may be used. LBCA 300 is further comprised of crossover 324, which is further comprised of shoulder 328, threaded connection 332, and seal face 336. It will be appreciated by those skilled in the art that other well-known coupling methods may be used in place of threaded connection 332. Crossover 324 may be coupled to union adapter 320 by seating shoulder 328 inside union adapter 320. LBCA 300 may be further comprised of seal 340, which sits within seal seat 316. When outer sleeve 304 is coupled to union adapter 320, seal 340 compresses onto seal face 336 to provide a sealed connection between outer sleeve 304 and crossover 324. LBCA 300 may further comprised of return coupler 346, which threads into return outlet 312.

LBCA 300 is further comprised of load spring 344, carabiner 348, eye screw 352, and hose 356. Load spring 344 is further comprised of hook 360 and spring 364, which may be integrally coupled as a single machined or fabricated component. Eye screw 352 may be threadably coupled to one of eye screw connections 306. Carabiner 348 may be coupled to eye screw 352 and hook 360. It will be appreciated that an additional eye screw 352 may be threadably coupled to another one of eye screw connections 306, and an additional carabiner 348 may be coupled to the additional eye screw 352. This additional eye screw and carabiner assembly may be coupled to hook 360 for additional support. Finally, hose 356 may be run through the inner diameter of spring 364 and hose channel 318.

LBCA 300 is further comprised of swage connection 368, swage plate 372, swage plate screws 376, and swage plate washers 380. Swage connection 368 is further comprised of hose connection 384, swage shoulder 388, and external hose fitting 392. After being threaded through hose channel 318, hose 356 is coupled to swage connection 368 by inserting hose connection 384 into the end of hose 356 until the end of hose 356 interfaces with swage shoulder 388. Swage connection 368 is then inserted in the opening of hose channel 318. Swage connection 368 may be secured to outer sleeve 304 by placing swage plate 372 over external hose fitting 392 and securing swage plate 372 to outer sleeve 304 by threadably coupling swage plate screws 376 and swage plate washers 380 to swage plate screw connections 314.

It will be appreciated that LBCA 300 may be coupled wellhead port of wellhead tree in accordance with some embodiments of the present inventions. For example, LBCA 300 may be coupled to wellhead port 124 of wellhead tree 128 and pump 136, tank 132, return hose 148, and return tank 152 depicted in FIG. 1. The free end of hose 356 is first inserted through wellhead port 124 and run downhole in the annulus between the inner diameter of an outer casing and the outer diameter of an inner casing. It will be appreciated that a hose 356 of a predetermined length may be selected to reach the desired depth. Once hose 356 is run downhole, threaded connection 332 is coupled to wellhead port 124. It will be appreciated that load spring 344 will provide increased tension against the outer diameter of hose 356 such to provide additional support against hose 356 falling downhole in the event hose 356 begins to become disconnected from swage connection 368. It will further be appreciated that an annulus 396 will be formed between the outer diameter of hose 356 and the inner diameter of crossover 324, and annulus 396 is in fluid communication with the annulus between the inner diameter of an outer casing and the outer diameter of an inner casing, as well as return channel 308 and return outlet 312. In such a configuration of the present invention, it will further be appreciated that pump 136 may be coupled to external hose fitting 392 using an external hose and coupling methods well-known in the art. A desired fluid may then be pumped downhole at a desired depth through hose 356 from tank 132 using pump 136. As desired fluid is pumped downhole from tank 132, existing fluid in the annulus between the inner diameter of an outer casing and the outer diameter of an inner casing is displaced. This displaced fluid travels through wellhead tree 128 and wellhead port 124 to annulus 396, return channel 308 and return outlet 312. Return hose 148 may couple return coupler 346 to return tank 152 in order to deposit displaced fluid in return tank 152.

The invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed.

The phrases "at least one", "one or more", and "and/or", as used herein, are open-ended expressions that are both conjunctive and disjunctive in operation. For example, each of the expressions "at least one of A, B, and C", "at least one of A, B, or C", "one or more of A, B, and C", "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification, drawings, and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts, and the equivalents thereof, shall include all those described in the summary of the invention, brief description of the drawings, detailed description, abstract, and claims themselves.

The foregoing description of the invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Consequently, variations and modifications commensurate with the above teachings and skill and knowledge of the relevant art are within the scope of the invention. The embodiments described herein above are further intended to explain best modes of practicing the invention and to enable others skilled in the art to utilize the invention in such a manner, or include other embodiments with various modifications as required by the particular application(s) or use(s) of the invention. Thus, it is intended that the claims be construed to include alternative embodiments to the extent permitted by the prior art.

What is claimed is:

1. A method of pumping a fluid in a wellbore, comprising:

providing a casing adapter that defines an enclosed volume, said casing adapter having an inlet, an outlet, and a port aperture all in operable communication with said enclosed volume;

deploying a hose having a proximal end and a distal end through said inlet, through said enclosed volume, and through said port aperture to divide said enclosed volume into a hose volume and an annulus volume, wherein a clearance is defined between an outer surface of said hose and an inner surface of said port aperture;

deploying said hose through a port of a wellhead and into a wellbore that extends from said wellhead until said distal end of said hose is a predetermined distance from said port of said wellhead;

selectively connecting said casing adapter to said wellhead so that said port aperture is in operable communication with said port of said wellhead and said wellbore;

pumping a first fluid through said inlet, through said hose and said hose volume, and out of said distal end of said hose into said wellhead; and receiving a second fluid from said wellhead, through said annulus volume, and out of said outlet.

2. The method of claim 1, further comprising:

retracting said hose through said wellbore, through said enclosed volume of said casing adaptor, and through said inlet.

3. The method of claim 1, wherein said hose has a relaxed outer diameter, and said hose has an expanded outer diameter when said first fluid is pumped through said hose, and wherein said expanded outer diameter is greater than said relaxed outer diameter.

4. The method of claim 1, further comprising:

applying a lubricant to said outer surface of said hose as said hose is deployed through said inlet.

5. The method of claim 1, wherein said hose is deployed through said inlet, through said enclosed volume, and through said port aperture prior to said port aperture being selectively connected to said port of said wellhead.

6. The method of claim 1, wherein said first fluid is pumped from a first reservoir operably connected to said inlet and said second fluid is received in a second reservoir operably connected to said outlet, and said first fluid is denser than said second fluid.

7. A casing adapter for deploying a hose in a wellbore, comprising:

a body defining an enclosed volume;

an inlet, an outlet, and a port aperture through said body of said casing adapter, wherein said inlet, said outlet, and said port aperture are in operable communication with said enclosed volume;

a hose extending through said inlet, said enclosed volume, and said port aperture to divide said enclosed volume into a hose volume and an annulus volume, wherein said hose is sealably connected to said inlet; and a clearance space between an outer surface of said hose and an inner surface of said port aperture such that said annulus volume is in operable communication with a wellbore.

8. The casing adapter of claim 7, wherein said body comprises:

a sleeve having said inlet and said outlet;

a crossover having said port aperture; and an adapter configured to secure a seal face of said crossover to a seal in said sleeve, and said adapter configured to selectively connect to said sleeve to sealably connect said crossover to said sleeve.

9. The casing adapter of claim 7, wherein said inlet is oriented along a first axis and said outlet is oriented along a second axis, and said first axis and said second axis are perpendicular to each other.

10. The casing adapter of claim 7, further comprising:

a spring positioned in said annulus volume, a first end of said spring connected to an inner surface of said body, and a second end of said spring forming a coil around said outer surface of said hose.

11. The casing adapter of claim 10, wherein said coil of said spring extends out of said port aperture.

12. The system of claim 7, further comprising:

at least one expandable rubber positioned in said inlet of said body, wherein said at least one expandable rubber is configured to contact said outer surface of said hose; and a lubrication reservoir in operable communication with said inlet of said body, wherein said lubrication reservoir is configured to provide a lubricant on said outer surface of said hose.

13. The system of claim 7, wherein said proximal end of said hose is positioned about an end of a swage connector, and said swage connector is connected to said body.

14. A system for deploying a hose in a wellbore, comprising:

a wellbore extending from a port of a wellhead, said wellbore comprising an inner tubular structure positioned in an outer tubular structure, wherein a predetermined distance extends between an outer surface of said inner tubular structure and an inner surface of said outer tubular structure;

a casing adaptor having a body and defining an enclosed volume;

an inlet, an outlet, and a port aperture through said body of said casing, wherein said inlet, said outlet, and said port aperture are in operable communication with said enclosed volume, and said port aperture is in operable communication with said port of said wellhead;

a hose extending through said inlet of said body, through said enclosed volume, through said port aperture, and into said wellbore, wherein said hose extends to a predetermined distance down said wellbore; and a pump operably connected to said inlet of said casing adapter, wherein said pump is configured to pump a fluid through said hose to said predetermined distance down said wellbore.

15. The system of claim 14, wherein said hose is expandable between a relaxed outer diameter and an expanded outer diameter, wherein said relaxed outer diameter is smaller than said predetermined distance and said expanded outer diameter is larger than said predetermined distance.

16. The system of claim 14, wherein said hose is comprised from a rigid material, and an outer diameter of said hose is less than said predetermined distance.

17. The system of claim 14, wherein an annular fluid between said inner tubular structure and said outer tubular structure is less dense than said fluid pumped to said predetermined distance down said wellbore.

18. The system of claim 14, wherein said hose divides said enclosed volume between a hose volume and an annulus volume, and wherein said casing adapter comprises a clearance between an outer surface of said hose and an inner surface of said port aperture such that said annulus volume is in operable communication with said port of said wellhead.

19. The system of claim 18, wherein an annular fluid from said wellbore passes through said port aperture into said annulus volume and out of said outlet into a reservoir tank.

20. The system of claim 14, wherein said inner tubular structure is production tubing and said outer tubular structure is a casing.

* * * * *